United States Patent [19]

Allen

[11] Patent Number: 4,823,508

[45] Date of Patent: Apr. 25, 1989

[54] COMBINED WINDOW OPERATOR AND HINGE

[75] Inventor: R. George Allen, Owatonna, Minn.

[73] Assignee: Truth Incorporated, Owatonna, Minn.

[21] Appl. No.: 119,177

[22] Filed: Nov. 10, 1987

[51] Int. Cl.[4] ..... E05D 15/42

[52] U.S. Cl. ..... 49/252; 49/260; 49/341

[58] Field of Search ..... 49/250, 251, 252, 260, 49/215, 81, 341, 324

[56] References Cited

U.S. PATENT DOCUMENTS

| | | | |
|---|---|---|---|
| 1,508,624 | 9/1924 | Soule | 49/81 |
| 2,711,316 | 6/1955 | South | 49/252 |
| 2,784,459 | 3/1957 | Anderberg | 49/450 |
| 3,345,777 | 10/1967 | Anderberg et al. | 49/248 |
| 4,253,276 | 3/1981 | Peterson et al. | 49/249 |
| 4,301,622 | 11/1981 | Dunsmoor | 49/342 |

FOREIGN PATENT DOCUMENTS

| | | | |
|---|---|---|---|
| 2047309 | 11/1980 | United Kingdom | 49/251 |

OTHER PUBLICATIONS

Drawing No. 14-61-00-100 of Truth Incorporated, dated 10-81.

A photo of a hinge developed by a German company, named Groetmeyer.

*Primary Examiner*—Kenneth J. Dorner
*Assistant Examiner*—Gerald A. Anderson
*Attorney, Agent, or Firm*—Wood, Dalton, Phillips, Mason & Rowe

[57] ABSTRACT

A combined window operator and hinge having a hinge with a track mountable to a window frame for a pivotal window and an operator case also mounted to the frame in spaced relation to the track. The hinge has a shoe movable along the track and a sash arm movable relative to the shoe as well as a control arm pivotally connected between the track and the sash arm. A lever, in the form of a bell crank, is pivoted to the shoe and to the control arm and has a connection to the operator through an operator arm and a drag link whereby torque may be imparted to the control arm for facilitating opening and closing movement of the hinge and window sash associated therewith with the application of minimal force to the operator.

7 Claims, 3 Drawing Sheets

COMBINED WINDOW OPERATOR AND HINGE

FIELD OF THE INVENTION

This invention relates to a combined operator and hinge for a pivotal window and, more particularly, a casement window wherein the hinge provides for mounting of the window sash in a window frame for movement between open and closed positions. An operator is integrally associated with the hinge in a manner to provide an extremely compact construction and provide improved operation in movement of the window sash.

BACKGROUND OF THE INVENTION

There are many different forms of hinge for a pivotal window, such as a casement or awning window. It is common to such hinges to have a track which can be mounted on the window frame, a sash arm which can be attached to the window sash, and one or more arms associated with the track and the sash arm which may pivot and with there being a shoe movably guided along the track.

One type of hinge has the sash arm mounted for movement with and pivotal movement relative to the shoe and another arm is a control arm pivoted to the sash arm intermediate its ends and to the track. Another type of hinge, referred to as a 6-bar hinge, has a kick-out link associated with the sash arm whereby an end of the sash arm can be cooperatively related with a guide hat at the end of the track and an additional arm extends between and is pivotally connected to a control arm intermediate its ends and to the shoe.

Various types of operators for pivotal windows are also known and can be either manually or power-driven to provide opening and closing movement of the window sash. The operator can be structurally associated with the window sash independently of the hinge.

It is also known to structurally interconnect an operator and a hinge whereby movement of an operator arm will cause hinge movement. However, such known structures, have lacked compactness, have not been operable with a minimal amount of force applied to the operator, and in at least one instance have had structure which can become disassembled during use.

In operation of a casement window, it is inherent that maximum torque be applied by the operator in moving the window sash outwardly from its closed position and in returning the window sash back to closed position with a lesser amount of torque required in intermediate positioning movements of the window. The prior art is not known to have a combined window operator and hinge of a compact construction which can fit into minimal space requirements for a window and which provides ease of opening and closing by structure which imparts torque to a control arm of the hinge which is pivotally connected at its opposite ends to a track and sash arm of the hinge.

SUMMARY OF THE INVENTION

A primary feature of the invention is to provide a combined window operator and hinge having an operator associated with the hinge by direct structural connection therebetween and wherein force applied through the operator is applied to a component of the hinge to impart maximum torque thereto in initial opening and final closing movements of the hinge.

The combined window operator and hinge has a hinge with a track mountable to a window frame and a sash arm mountable to a window sash. An end of the sash arm is mounted for pivotal movement relative to the shoe as well as for movement with the shoe along the track and a control arm pivoted at one end to the track and at its other end to the sash arm intermediate the ends thereof functions to control the shoe and sash arm movements. The operator has an operator arm movable through an arc and operatively connected to a lever pivotally mounted on the shoe and which is also pivotally connected to the control arm intermediate its ends. With the hinge in window-closed position, the lever is positioned and connected to the operator arm in a relation whereby initiation of movement of the operator arm through its arc imparts substantial torque to the control arm to exert a moving force on the sash arm and with the force of the operator arm also being applied to the lever in a direction to urge the shoe along the track simultaneously with the movement of the sash arm. This relation similarly exists for ease of operation and imparting of substantial torque to the control arm during final movement of the hinge to window closed position.

An object of the invention is to provide a new and improved combined window operator and hinge and, more particularly, such a device for a casement window.

Another object of the invention is to provide a combined window operator and hinge wherein said hinge has an elongate track, a shoe movable along said track, a sash arm, means mounting said sash arm for movement with and pivotal movement relative to said shoe, a control arm having a first pivot connection at one end to said track and a second pivot connection at an opposite end to the sash arm intermediate the ends of the latter, said hinge having a window-closed position wherein said sash arm overlies said control arm, and means pivotally connected to said control arm intermediate the ends thereof for imparting torque to said control arm for pivoting thereof about said first pivot connection to exert a moving force on the sash arm.

Still another object of the invention is to provide a combined operator and hinge for a casement window wherein said hinge has an elongate track, a shoe movable along said track, a sash arm, means including a kick-out link pivoted on said shoe mounting said sash arm for movement with and pivotal movement relative to said shoe, a control arm having a first pivot connection at one end to said track and a second pivot connection at an opposite end to the sash arm intermediate the ends of the latter, said hinge having a window-closed position wherein said sash arm overlies said control arm, and lever means pivoted on said shoe and pivotally connected to said control arm intermediate the ends thereof for imparting torque to said control arm for pivoting thereof about said first pivot connection to exert a force on the sash arm in a direction to urge the sash arm in a window-opening direction with simultaneous movement of the shoe along the track.

An additional object of the invention is to provide a combined operator and hinge for a pivotal window sash comprising, a track mountable to a window frame, a shoe adjacent one end of the track and movable along the track, a sash arm, means mounting the sash arm to said shoe for pivotal movement relative thereto, a control arm having first and second ends with a first end pivotally connected to the track and the second end pivotally connected to the sash arm intermediate its ends, an operator mountable on the window frame and having an operator arm movable through an arc and of a length to pass over the track in movement of the sash arm between window-open and window-closed positions, a bell crank pivoted intermediate its ends on said shoe and pivotally connected at one end thereof to said control arm intermediate the ends of the control arm, and a drag link extending between and pivotally connected to the other end of the bell crank and to said operator arm.

DESCRIPTION OF THE PREFERRED EMBODIMENT

Figure 1:
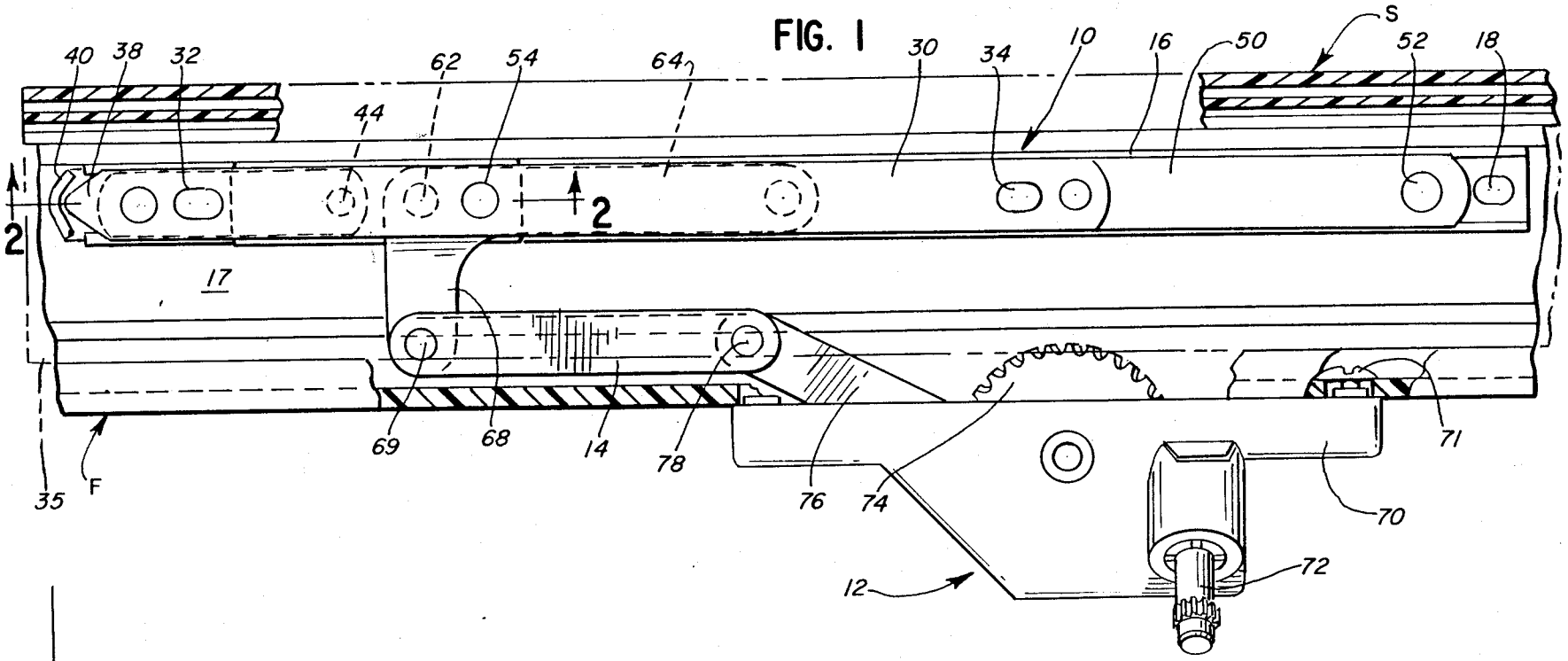
FIG. 1 is a plan view of the combined window operator and hinge associated with a window, with the hinge in window-closed position.

The combined window operator and hinge is shown in the drawings in various operative positions.

Figure 3:
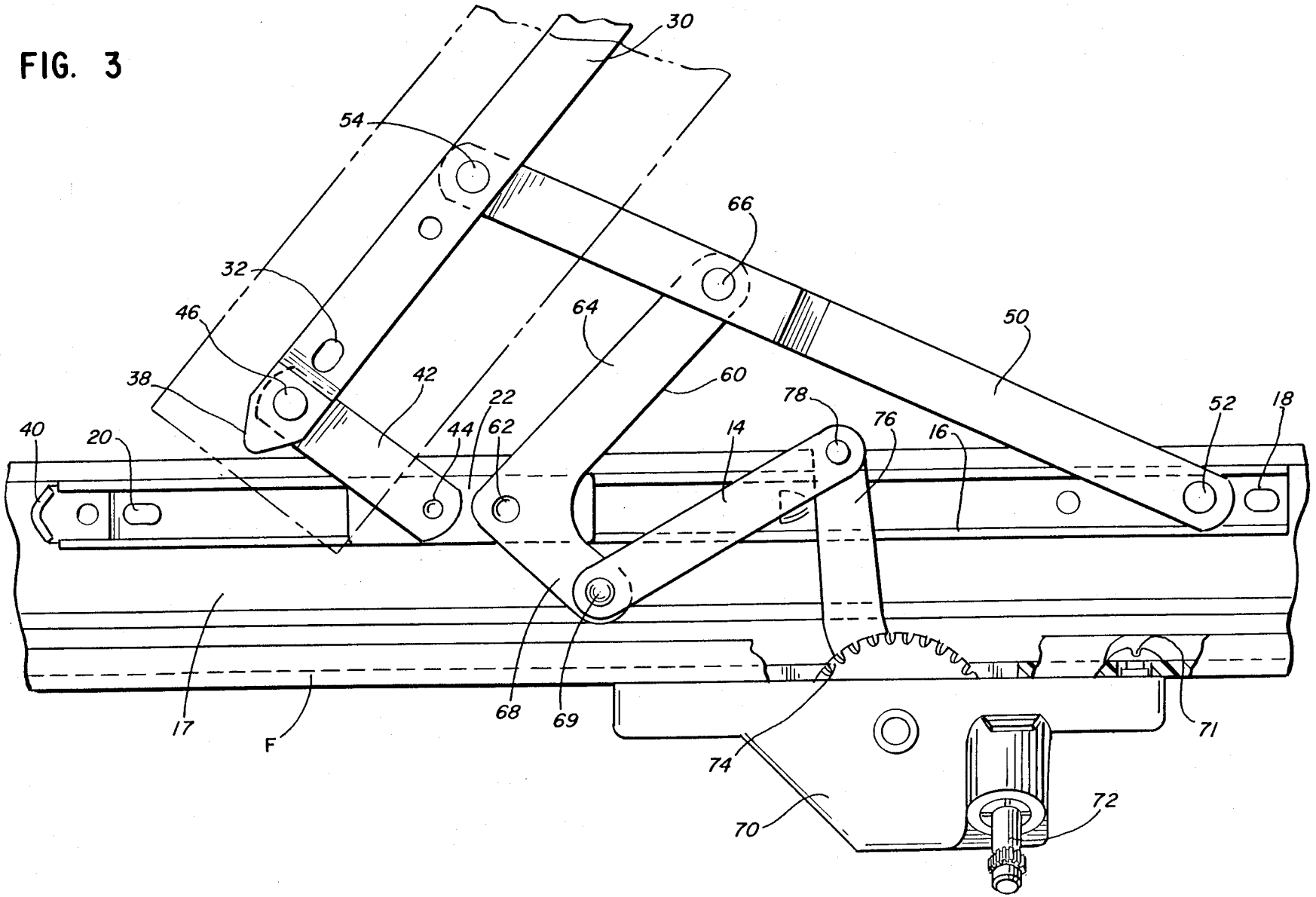
FIG. 3 is a view, similar to FIG. 1, showing the components positioned in an intermediate position.
Figures 4, 5:
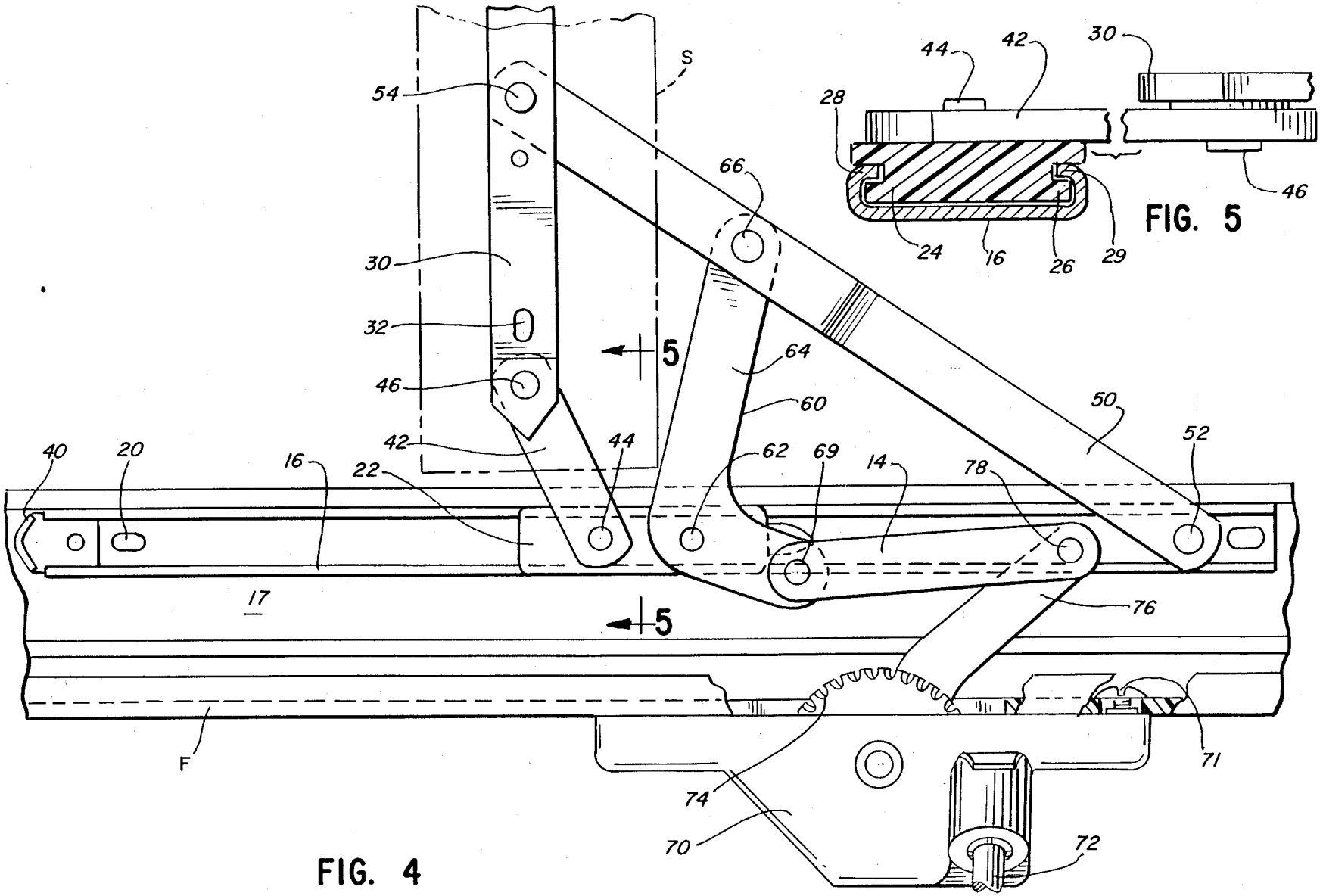
FIG. 4 is a view, similar to FIG. 1, showing the components in a position with the window fully open.
FIG. 5 is a transverse section, taken generally along the line 5—5 in FIG. 4 and on an enlarged scale.

In FIG. 1, the hinge is in window-closed position, while in FIG. 4, the hinge is in full window-open position and FIG. 3 illustrates the hinge in an intermediate position.

The hinge is indicated generally at 10 and the operator is indicated generally at 12 and the connection therebetween is provided by a drag link 14 more particularly described hereinafter.

The hinge 10 has a track 16 which can be mounted to a planar member of a window frame F by attaching means extending through a plurality of openings formed in the track, including the openings 18 and 20.

The track 16 movably mounts a shoe 22 with the interaction therebetween being shown particularly in FIG. 5. The shoe 22 has grooved sections 24 and 26 which fit beneath inturned track sections 28 and 29 whereby the shoe is movable along the track and is captured against removal. The shoe can initially be associated with the track by endwise insertion into the track at the end thereof adjacent the opening 18.

The hinge includes a sash arm 30 having openings 32 and 34 facilitating attachment to the underside of a window sash, such as the pivotal window sash S of a casement window. The attachment is to the underside of a planar member 35 of the sash S and which is shown in broken line in FIG. 1.

The sash arm 30 can assume various positions between the window-closed position shown in FIG. 1 and the full window open position shown in FIG. 4 and with the sash arm having pivotal movement relative to the shoe 22. In the window-closed position of the hinge, a V-shaped end 38 of the sash arm is positioned within a shaped guide hat 40 at an end of the track 16. As known in the art, this structure assures tight fitting of the window sash to the window frame when the window is closed. In initial movement of the hinge from the window-closed position of FIG. 1 toward the position of FIG. 3, the shaped end 38 moves away from the guide hat 40 because of its pivotal movement as well as movement with the shoe 22. The action is facilitated by a kick-out link 42 which has a rivet-type pivot connection 44 to the shoe at one end and a rivet-type connection 46 at its other end to the sash arm 30. Movement of the sash arm 30 is controlled by a control arm 50 which has a rivet-type pivot connection 52 pivotally connecting an end of the control arm in fixed pivotal relation to the track 16 and a rivet-type pivot connection 54 at its opposite end to the sash arm 30 intermediate the length of the latter.

A lever, in the form of a bell crank 60, has a rivet-type pivot connection 62 to the shoe 22 and has one arm 64 having a rivet-type pivot connection 66 to the control arm 50 intermediate the ends of the latter and functioning as a known type of guide bar in the disclosed type of hinge. A second arm 68 of the bell crank has a pivot connection at an end thereof to the previously-mentioned drag link 14 and this releasable connection can be formed by a snap stud structure, as disclosed in Tacheny et al. Pat. No. 4,593,341. The snap stud includes a stud member 69 carried by the bell crank arm 68 and which extends through an opening in an end of the drag link 14. The stud has a compressible spring member which overlies the upper face of the drag link to retain the parts in assembled pivoted relation, but the parts are separable by an upward force on the drag link 14 for separation thereof from the bell crank arm 68.

Figure 2:
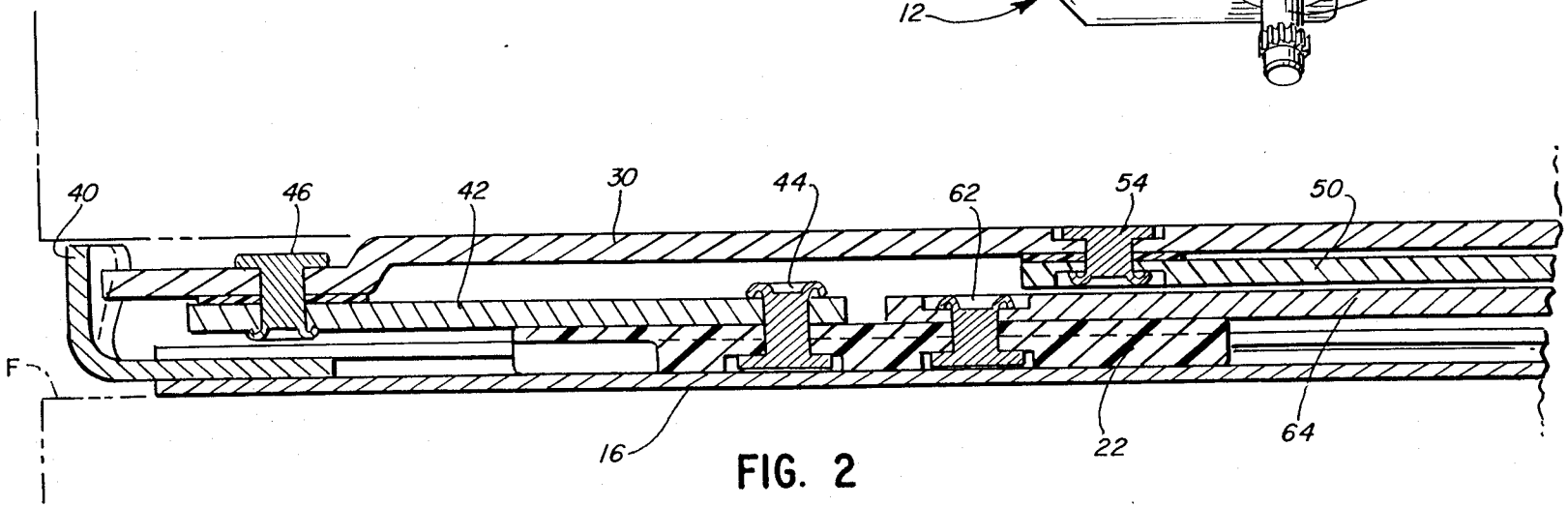
FIG. 2 is a fragmentary elevational view of a portion of the structure shown in FIG. 1, on an enlarged scale and taken generally along the line 2—2 in FIG. 1.

As seen in FIGS. 1 and 2, the components of the hinge define a compact, stacked relation of elements with the hinge in window-closed position and with the bell crank arm 64 disposed directly beneath the control arm 50 and in alignment therewith and with the bell crank arm 68 extending outwardly from the hinge track and generally normal thereto and with the drag link 14 extending generally parallel to the track 16. This provides for a minimum space requirement between the hinge and the operator 12 and for imparting substantial torque to the control arm 50 in initial opening and final closing of the window as derived from operation of the operator 12.

The operator 12 is of a generally conventional structure having a case 70 which is attached to the frame F of the window by threaded members 71 and, thus, has a fixed relation to the mounting of the track 16. A handle (not shown) is rotatably mounted on a shaft 72 extending into the case 70 and a worm thereon (not shown) meshes with a rotatably-mounted sector gear 74 and which has an arm 76 extending outwardly therefrom and fixed thereto for rotation in an arc in response to rotation of the sector gear by rotation of the shaft 72. An end of the operator arm 76 is connected to an end of the drag link 14 by a snap stud connection having a stud 78 and with this connection being of the same construction as that described for the connection between the drag link 14 and the bell crank arm 68.

A sequence of operation may be described as follows: With the hinge in window-closed position, as shown in FIG. 1, the handle shaft 72 is rotated to move the operator arm 76 through a clockwise arc to exert a pull on the drag link 14 with resulting pivoting of the bell crank 60. This imparts substantial torque to the control arm 50 and also exerts a pulling force on the shoe 22 whereby the sash arm is caused to move from the position shown in FIG. 1 toward the position shown in FIG. 3. When the operator arm 76 is moved through its complete arc to the position shown in FIG. 4, the window is fully open and the sash arm 30 is shown as extending generally perpendicular to the track 16.

As the window is closed, the operator arm 76 moves to the position shown in FIG. 1 and exerts substantial torque on the control arm 50 to bring the sash arm 30 to the window-closed position shown in FIG. 1.

I claim:

1. A combined window operator and hinge wherein said hinge has an elongate track, a shoe movable along said track, a sash arm, means mounting said sash arm for movement with and pivotal movement relative to said shoe, a control arm having a first pivot connection at one end to said track and a second pivot connection at an opposite end to the sash arm intermediate said one end and opposite end of the sash arm, said hinge having a window-closed position wherein said sash arm overlies said control arm, and means pivotally connected to said control arm intermediate said one end and opposite end of the control arm for imparting torque to said control arm for pivoting thereof about said first pivot connection to exert a moving force on the sash arm and comprising a bell crank pivoted on said shoe and having one end thereof making said pivot connection to the control arm, a movable operator arm, and a drag link extending parallel to said track when the hinge is in said window-closed position and pivotally connected to the operator arm and to the other end of the bell crank.

2. A combined window operator and hinge as defined in claim 1 wherein said bell crank has a pair of arms with the arm having the end making the pivot connection to the control arm having a width approximately equal to the width of the control arm and nested between the track and control arm when the hinge is in said window-closed position.

3. A combined window operator and hinge as defined in claim 2 wherein said pivot connection of the bell crank arm to the control arm is positioned intermediate the first pivot connection of the control arm and the shoe when the hinge is in window-closed position.

4. A combined operator and hinge for a pivotal window sash comprising, a track for mounting on a window frame, a shoe adjacent one end of the track and movable along the track, a sash arm having ends, means mounting the sash arm to said shoe for pivotal movement relative thereto, a control arm having first and second ends with the arm first end pivotally connected to the track and the arm second end pivotally connected to the sash arm intermediate the ends of the sash arm, an operator for mounting on the window frame and having an operator arm movable through an arc and of a length to pass over the track in movement of the sash arm between window-open and window-closed positions, a bell crank with first and second ends and pivoted intermediate the bell crank ends on said shoe and pivotally connected at said first end of the bell crank to said control arm intermediate the first and second ends of the control arm, and a drag link extending between and pivotally connected to the second end of the bell crank and to said operator arm.

5. A combined operator and hinge as defined in claim 4 wherein said operator and track are spaced apart and said drag link is in said space and extends generally parallel to the track when the hinge is in window-closed position.

6. A combined operator and hinge in combination with a window sash pivotally mounted relative to a window frame comprising: a hinge having a track having ends and mounted on the window frame, a shoe movably guided on the track and adjacent one end of the track, a sash arm having ends and mounted to the window sash, a kick-out link with first and second ends pivotally connected at the link first end to said shoe and pivotally connect at the link second end to an end of the sash arm, and a control arm having first and second ends with an arm first end pivotally connected to the track and the arm second end pivotally connected to the sash arm intermediate the sash arm ends; an operator mounted on the window frame at a fixed distance from the track and having an operator arm movable through an arc and of a length to pass over the track in movement between window-open and window-closed positions; a bell crank having a pair of arms each with an end and pivoted intermediate the ends of said arms on said shoe and having one of said arms pivotally connected at an arm end to said control arm intermediate the ends of the control arm, and a drag link overlying and pivotally connected to the arm end of the other arm of the bell crank and to said operator arm, said one arm of the bell crank being in alignment with the control arm which is in alignment with the track when the hinge is in window-closed position and said drag link extending generally parallel to said track.

7. A combined operator and hinge in combination with a window sash pivotally mounted relative to a window frame comprising: a hinge having a track with ends and mounted on the window frame, a shoe movably guided on the track and adjacent one end of the track, a sash arm having ends and mounted to the window sash, a kick-out link with first and second ends pivotally connected at the link first end to said shoe and pivotally connected at the link second end to an end of the sash arm, and a control arm having first and second ends with an arm first end pivotally connected to the track and the arm second end pivotally connected to the sash arm intermediate the sash arm ends; an operator mounted on the window frame at a fixed distance from the track and having an operator arm movable through an arc and of a length to pass over the track in movement between window-open and window-closed positions; a bell crank having a pair of arms with ends and pivoted intermediate the bell crank arm ends on said shoe and having one of said arms pivotally connected at an arm end to said control arm intermediate the ends of the control arm, and a drag link overlying and pivotally connected to the arm end of the other arm of the bell crank and to said operator arm, said operator arm, drag link, bell crank and shoe being constructed and arranged whereby movement of the operator arm in said arc to open the window is in the same direction as the movement of the shoe along the track during opening movement of the window.

* * * * *